US005653093A

United States Patent [19]

Delledonne

[11] Patent Number: 5,653,093

[45] Date of Patent: Aug. 5, 1997

[54] METHOD AND APPARATUS TO MAINTAIN THE CHARACTERISTICS OF A THERMOPLASTIC FILM AT CONSTANT VALUES

[75] Inventor: Joseph Delledonne, Herstal, Belgium

[73] Assignee: A.W.A.X Progettazione E Ricerca S.r.l., Italy

[21] Appl. No.: 542,402

[22] Filed: Oct. 12, 1995

[30] Foreign Application Priority Data

Dec. 5, 1994 [BE] Belgium ..... 09401097

[51] Int. Cl.[6] ..... B65B 53/00

[52] U.S. Cl. ..... 53/441; 53/556; 53/141

[58] Field of Search ..... 53/141, 556, 228, 53/441, 466

[56] References Cited

U.S. PATENT DOCUMENTS

| | | | |
|---|---|---|---|
| 3,848,393 | 11/1974 | Monoghan | 53/141 X |
| 4,051,643 | 10/1977 | Saito . | |
| 4,465,450 | 8/1984 | Dermansky | 53/441 |
| 4,541,225 | 9/1985 | Byland | 53/441 |
| 4,616,474 | 10/1986 | Morley et al. . | |
| 4,757,451 | 7/1988 | Denda | 53/556 X |
| 5,029,430 | 7/1991 | Davis | 53/141 |
| 5,115,620 | 5/1992 | Takamura . | |

FOREIGN PATENT DOCUMENTS

| | | |
|---|---|---|
| 0378730 | 7/1990 | European Pat. Off. . |
| 0569615 | 11/1993 | European Pat. Off. . |
| 2146464 | 3/1972 | Germany . |
| 2124176 | 2/1984 | United Kingdom . |

*Primary Examiner*—Linda Johnson
*Attorney, Agent, or Firm*—Larson and Taylor

[57] ABSTRACT

The film, which is cyclically extended in the station for wrapping the product, is acted on by a jet of hot air supplied from a therm-electric generator controlled by a control logic unit which through suitable sensors measures the ambient temperature and the temperature of the film and controls any other inputs, so that the film is kept in optimal and substantially constant conditions to react without tearing to the pre-stretching and/or stretching to which it is normally subjected in the product packaging cycle.

12 Claims, 2 Drawing Sheets

METHOD AND APPARATUS TO MAINTAIN THE CHARACTERISTICS OF A THERMOPLASTIC FILM AT CONSTANT VALUES

BACKGROUND OF THE INVENTION

Most of the thermoplastic films used in the packaging of food products which must be kept in refrigerated environments, and particularly the stretchable films, undergo abrupt changes of their chemical and physical characteristics, particularly their elastic and plastic characteristics, at the low temperatures which must be maintained even during the packaging of such products, and become extremely fragile, with a risk of tearing during the stages of pre-stretching and/or stretching to which such films are normally subjected when in use. The threshold of practical risk varies with the chemical composition of the film, for example according to whether it is made of polyethylene (PE) or polyvinyl chloride (PVC), and rises exponentially with a decrease in temperature.

SUMMARY OF THE INVENTION

The object of the invention is to avoid this problem with a controlled supply of heat to the portion of film cyclically used in a packaging machine, to ensure that the elastic and plastic characteristics of the film remain at values which are optimal and as constant as possible. To achieve this object, the invention proposes the following operating process:

The heat is supplied to the portion of film cyclically unwound from the feed reel and extended in the packaging station, at least before the film is subjected to the stage of pre-stretching or stretching normally provided in the product packaging cycle;

the heat is supplied in the form of a flow of hot air and is directed against the lower face of the film in such a way that use is made of the natural tendency of heat to rise and the wall effect of the fluid directed against the extended film, so that the flow of hot air conditions the film in a uniformly distributed way and with minimal heat dispersion;

the flow of hot air is preferably supplied in the longitudinal direction of the portion of film unwound from the reel, and the device supplying this flow of hot air is disposed next to one end of the said portion of film, preferably at the end opposite that connected to the reel, in such a way that the heat dispersed in other ways is applied to the means of supply of the film, including the reel;

if necessary, suction may be created at the end of the portion of film opposite that acted on initially by the flow of hot air, to collect the excess hot air, which may be removed and dispersed in any way, or may be recycled through the hot air generator.

For the application of this process, the invention proposes equipment which comprises a hot air generator provided with a flat supply aperture, substantially as wide as the portion of film unwound from the reel and provided with a set of selectively activated electrical resistances and an electric fan which is preferably of the variable-speed type. The operation of the hot air generator is controlled by a control logic unit to whose inputs all or some of the signals relating to the following variables are connected:

the presence or absence of the film in the packaging station;

the ambient temperature;

the temperature of one or more areas in which the flow of hot air interacts with the film;

the type of film used;

the dimensions of the product to be packaged and the consequent extent of the pre-stretching and/or stretching to which the film has to be subjected.

The control logic unit processes the collected data according to a suitable algorithm and cyclically activates the hot air generator, changing the operating temperature thereof and if necessary the speed of rotation of the fan, to ensure that the temperature of the portion of film cyclically extended in the packaging station and acted on by the flow of hot air is maintained at values such that the elastic and plastic characteristics of the said film remain at optimal and practically constant values.

BRIEF DESCRIPTION OF THE DRAWINGS

Further characteristics of the invention, and the advantages derived therefrom, will be clearly understood from the following description of a preferred embodiment of the invention, illustrated solely by way of example and without restriction, in the figures on the two attached sheets of drawings, in which.

DETAILED DESCRIPTION OF THE PREFERRED EMBODIMENTS

Figure 1:
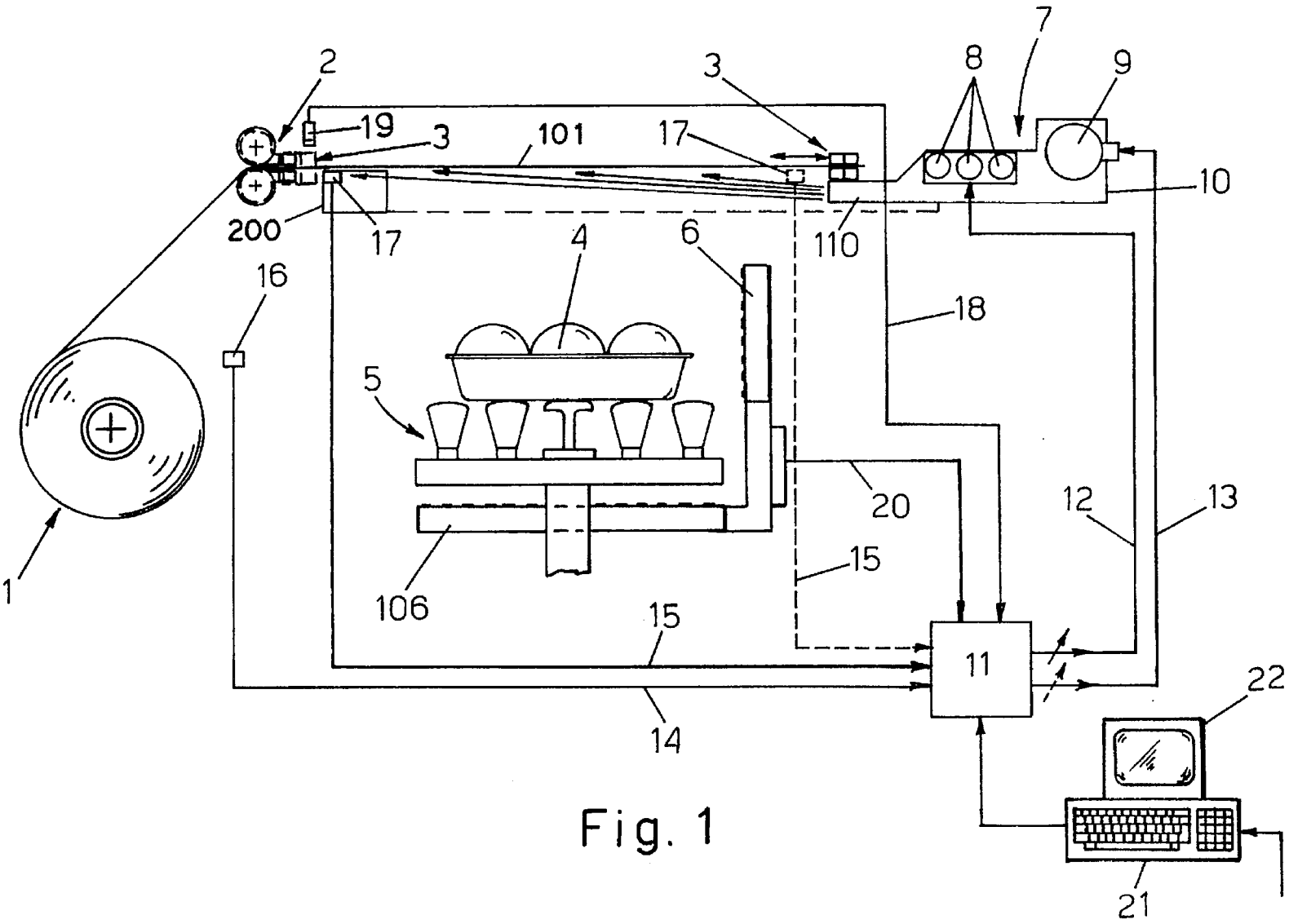
FIG. 1 is a schematic side view of a packaging machine with the equipment according to the invention.
Figure 3:
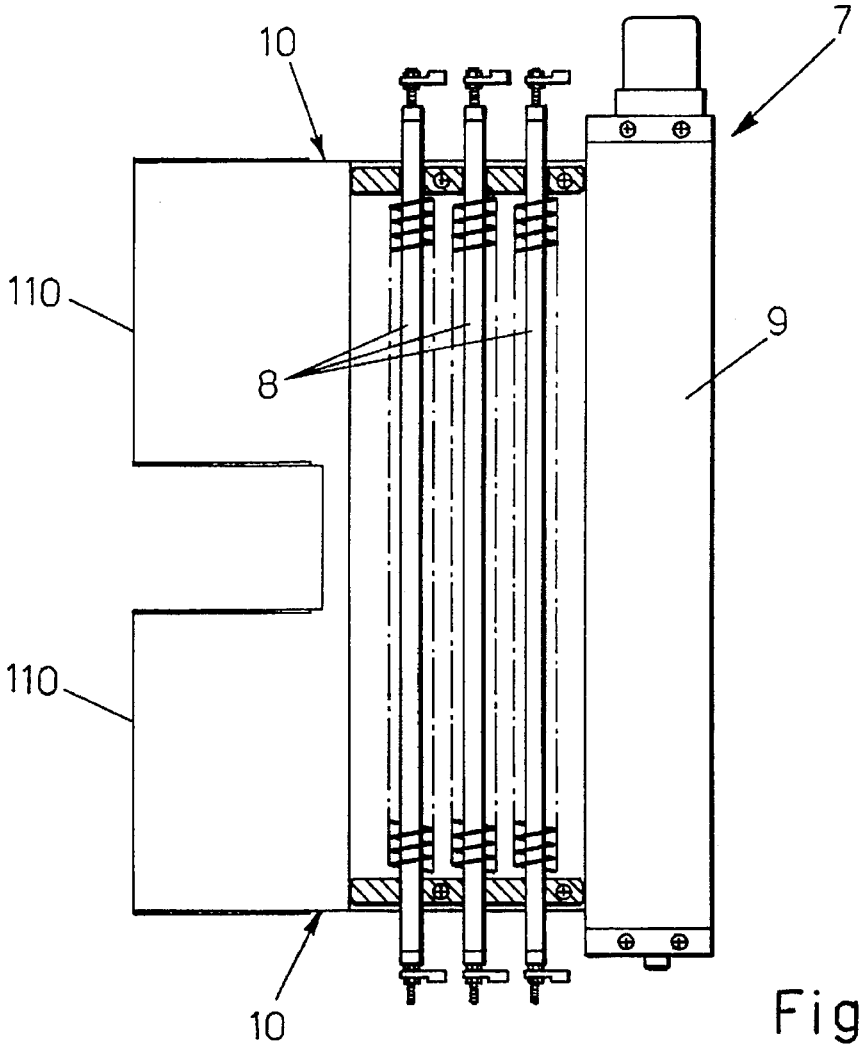
FIG. 3 shows the hot air generator in a plan view from above and in partial section.
Figure 2:
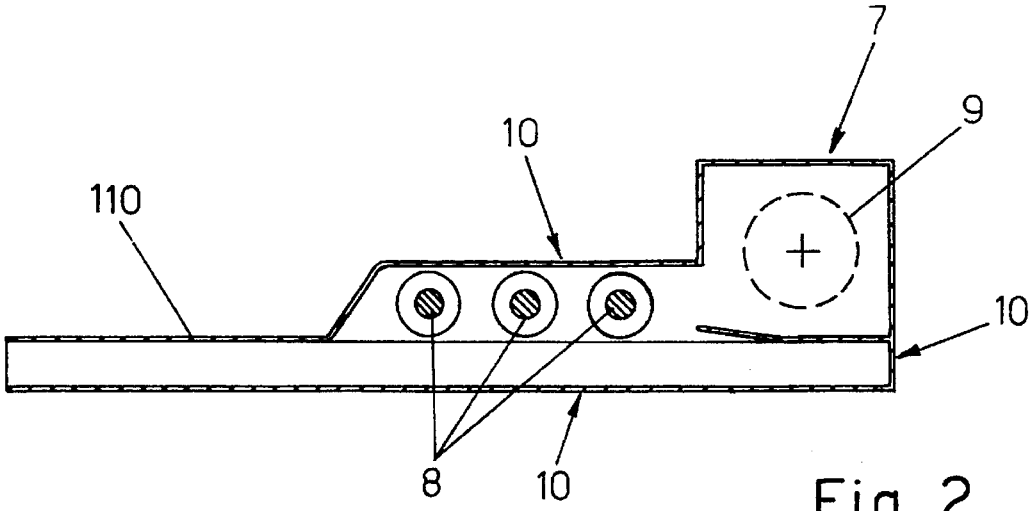
FIG. 2 shows the hot air generator on a larger scale than that of the preceding diagram, and in transverse section.

FIG. 1 shows schematically the typical composition of a machine for packaging products with stretchable film, having at least one reel 1 from which the wrapping film is unwound cyclically by suitable means and is fed to a fixed distributor 2 from which the film is gripped at its end by a clamp 3 which moves horizontally with a travel proportional to the dimensions of the product 4 to be packaged, to extend a portion of film 101 of adequate length above said product 4. During the transfer of the product 4 to the elevator 5 by a controlled-speed conveyor (not illustrated), known means 6-106 measure the dimensions of the product (width, length, height and flaring), to permit the logical control of the clamp 3.

According to the invention, a hot air generator 7 is provided next to the clamp 3 when the latter is in the position remote from the distributor 2, and this generator comprises: a set of electrical resistances 8; an electric fan 9 which sucks in ambient air and directs it onto the whole extension of the set of resistances; a chamber 10 which guides the air leaving the electric fan against the set of resistances 8 and directs the hot air in a uniformly distributed way under the portion of film 101 extended over the product 4 to be packaged and over the whole transverse extension of the film. For this last purpose, the chamber 10 is provided with two or more adjacent flat discharge apertures 110 disposed under the clamp 3 and designed and orientated in such a way that the air discharged from them is made to contact the lower face of the portion of film 101 as uniformly as possible.

The motor of the electric fan 9 may be of the fixed- or variable-speed type.

Reference numeral 11 schematically indicates an electronic microprocessor-based programmable control unit, which through suitable interfaces and multiple-wire links 12–13 controls, respectively, the set of resistances 8 to vary the quantity of heat produced by it, and the motor of the electric fan 9, by varying its speed if necessary.

Through the multiple-wire links 14–15, the unit 11 receives, respectively, the data relating to the ambient temperature in which the film feeding means operate, measured by at least one sensor 16 suitably remote from the generator 7 and disposed, for example, next to the reel 1, and the data on the temperature of the portion of film 101, measured by one or more sensors 17 located next to this portion of film. Operating with a predetermined algorithm, the unit 11 reads the electrical signal corresponding to the ambient temperature, and controls the parts 8–9 in a logical way, to ensure that the portion of film 101 is contacted by a flow of hot air which brings it into the best condition for pre-stretching. The electrical signal from the sensors 17 is used as a feedback signal and to avoid the exceeding of a maximum safety limit in the heating of the film 101.

Suction means 200 may be created at the end of the portion of film opposite that acted on initially by the flow of hot air, to collects the excess hot air, which may be recycled through the hot air generator 7.

The hot air generator 7 is activated at least during the unwinding of the portion of film 101 from the reel 1, and possibly also during the pre-stretching of the film, and is switched off automatically before the product 4 is raised against the film 101 for the packaging of the product. This timed activation of the generator 7 is provided by the unit 11 through its own timing means and with the multiple-wire link 18 to a sensor 19 which measures, for example, the position of the clamp 3 at the end of the active travel, for taking the end of the film from the distributor 2.

The unit 11 may also modify the operation of the generator 7 according to the dimensions of the product 4 to be packaged and consequently according to the extent of pre-stretching of the film 101. For this purpose, the unit 11 may be provided with a multiple-wire link 20 to the means 6-106 already mentioned in the introduction to the present disclosure.

The unit 11 may also modify the operation of the generator 7 according to the type of film used and/or other variables, and for this purpose the unit 11 may be linked to a programming and interrogation keyboard 21 and to a visual display unit 22 which displays the various parameters.

The control system 11-21-22 may be independent of that of the packaging machine, or may be integrated in the machine control system, with serial connections and predetermined communications protocols, the whole being done in a way that will be understood and easily applied by those skilled in the art. In the latter case, the sensor 19 is not used, since the starting of the hot air generator 7 is controlled by the computer of the packaging machine.

I claim:

1. A method for maintaining elastic and plastic characteristics of a film of stretchable thermoplastic material at optimal and substantially constant values during packaging of products, comprising the steps of:

positioning a portion of the film in a packaging system;

measuring temperature of surrounding environment in which the portion is used and determining whether said measured temperature is lower than an ideal temperature at which the film presents the best deformability characteristics for packaging;

thermally conditioning said film until the measured temperature of said environment reaches said ideal temperature by blowing hot air onto the portion of film positioned in the product packaging station;

interrupting thermal conditioning;

raising the product against the film after said step of interrupting; and packaging said product.

2. A method according to claim 1, further comprising at least one of pre-stretching the film during the thermal conditioning step and stretching the film during the packaging step.

3. A method according to claim 1, further comprising blowing the hot air onto a lower face of the portion of film positioned in the product packaging station.

4. A method according to claim 1, further comprising blowing hot air for thermal conditioning onto the lower face of the film in a longitudinal direction and in a direction opposed to a remainder of unwound film.

5. A method according to claim 1, further comprising limiting the path of the said hot air substantially to the portion of film positioned in the product packaging station by locating a suction system opposite an origin of said hot air.

6. A method according to claim 5, further comprising recycling said hot air through said hot air origin.

7. An apparatus for maintaining elastic and plastic characteristics of a film of stretchable, thermoplastic material at a substantially constant and optimal value during packaging of products, comprising:

a product packaging station including means for feeding a portion of said film, and means for at least one of pre-stretching and stretching said film;

generator means for generating at least one flow of hot air with a variable temperature to thermally condition the portion of said film;

at least one environment sensor for measuring a temperature value of an environment in which the means for feeding the portion of said film operates, and for generating a proportional electrical signal;

at least one control logic unit which receives as input the electrical signal generated by said environment sensor, and which controls said hot air generator means so that the film acted on by the hot air is stretchable by said pre-stretching and stretching means;

at least one film sensor for measuring film temperature of said film thermally conditioned by the hot air generator, wherein each of said film sensors sends a proportional electrical signal to said control logic unit for use as a feedback and safety signal to prevent exceeding critical temperatures; and means for detecting a presence of the film in the product packaging station, for indicating said film presence to said control logic unit, for ensuring conditioning of the film by said hot air generator before pre-stretching and stretching, and for switching said hot air generator off before raising a product up to said film to package the product.

8. An apparatus according to claim 7, further comprising means for measuring dimensions of the product to be packaged, and an input connected to said dimension measuring means and to said control logic unit.

9. An apparatus according to claim 7, wherein the control logic unit further comprises means for modifying operation of the hot air generator according to a variable type of film used and wherein said variable type of film is entered into the said control logic unit by said keyboard.

10. An apparatus according to claim 7, further comprising an electronic control system for said apparatus independent of the control logic unit and the means for programming and interrogating.

11. An apparatus according to claim 7, wherein the control logic unit and the means for programming and interrogating are integrated into an electronic control system of said apparatus by means of serial connections and communications protocols.

12. An apparatus according to claim 7, further comprising directing means for directing said flow of hot air onto a lower face of the portion of said film.

* * * * *